US011214855B2

(12) United States Patent
Hidaka et al.

(10) Patent No.: US 11,214,855 B2
(45) Date of Patent: Jan. 4, 2022

(54) PIERCER PLUG AND METHOD OF MANUFACTURING THE SAME

(71) Applicant: Nippon Steel Corporation, Tokyo (JP)

(72) Inventors: Yasuyoshi Hidaka, Tokyo (JP); Naoya Shirasawa, Tokyo (JP); Tatsuya Miyai, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 16/646,739

(22) PCT Filed: Aug. 9, 2018

(86) PCT No.: PCT/JP2018/029879

§ 371 (c)(1),
(2) Date: Mar. 12, 2020

(87) PCT Pub. No.: WO2019/087510

PCT Pub. Date: May 9, 2019

(65) Prior Publication Data

US 2020/0263282 A1 Aug. 20, 2020

(30) Foreign Application Priority Data

Nov. 2, 2017 (JP) ..... JP2017-212753

(51) Int. Cl.
*C22C 38/44* (2006.01)
*C22C 38/02* (2006.01)
(Continued)

(52) U.S. Cl.
CPC ..... *C22C 38/44* (2013.01); *C21D 9/00* (2013.01); *C22C 38/02* (2013.01); *C22C 38/04* (2013.01);
(Continued)

(58) Field of Classification Search
CPC ..... C22C 38/44; C22C 38/02; C22C 38/04
(Continued)

(56) References Cited

U.S. PATENT DOCUMENTS 3,655,244 A * 4/1972 Swisher ..... B25D 17/02 299/113
5,031,434 A * 7/1991 Takase ..... B21B 25/00 72/97
2018/0354008 A1* 12/2018 Yamamoto ..... C21D 6/005

FOREIGN PATENT DOCUMENTS

CN 101078092 A 11/2007
CN 104233100 A 12/2014
(Continued)

OTHER PUBLICATIONS

Wang et al., CN 104988416 A machine translation, Oct. 21, 20215, entire translation (Year: 2015).*
(Continued)

*Primary Examiner* — Humera N. Sheikh
*Assistant Examiner* — Katherine A Christy
(74) *Attorney, Agent, or Firm* — Banner & Witcoff, Ltd.

(57) ABSTRACT

A piercer plug with increased recyclability is provided. A piercer plug (1) has a chemical composition of, in mass %: 0.15 to 0.30% C; 0.4 to 1.2% Si; 0.2 to 1.5% Mn; 0.1 to 2.0% Ni; 0 to 4.0% Mo and 0 to 4.0% W, where the total content of Mo and W is 1.0 to 6.0%; higher than 1.0% and not higher than 4.0% Cr; 0 to 0.2% B; 0 to 1.0% Nb; 0 to 1.0% V; 0 to 1.0% Ti; and balance Fe and impurities, the plug including a tip portion (2) and a trunk portion (3) made of the same material as the tip portion (2) and contiguous to the tip portion (2). The trunk portion (3) includes a cylindrical portion (5) having a hole used to mount a bar. The tip portion (2) is harder than the cylindrical portion (5).

4 Claims, 6 Drawing Sheets

(51) Int. Cl.

| | |
|---|---|
| ***C22C 38/04*** | (2006.01) |
| ***C21D 9/00*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.
CPC ..... *C22C 38/46* (2013.01); *C22C 38/48* (2013.01); *C22C 38/50* (2013.01); *C22C 38/54* (2013.01)

(58) Field of Classification Search
USPC ..... 420/106
See application file for complete search history.

(56) References Cited

FOREIGN PATENT DOCUMENTS

| | | | |
|---|---|---|---|
| CN | 104988416 | A * | 10/2015 |
| JP | 2683861 | B2 | 12/1997 |
| JP | 2776256 | B2 | 7/1998 |
| JP | 2778140 | B2 | 7/1998 |
| JP | 2819906 | B2 | 11/1998 |
| JP | 5440741 | B1 | 3/2014 |
| JP | 5464300 | B1 | 4/2014 |
| WO | 2014050975 | A1 | 4/2014 |
| WO | 2017051632 | A1 | 3/2017 |

OTHER PUBLICATIONS

English Abstract & Family List of JP2683861B2.
English Abstract & Family List of JP5464300B1.
English Abstract & Family List of JP5440741B1.
English Abstract & Family List of JP2776256B2.
English Abstract & Family List of JP2778140B2.
English Abstract & Family List of JP2819906B2.
English Abstract & Family List of WO2014050975A1.
English Abstract & Family List of WO2017051632A1.

* cited by examiner

PIERCER PLUG AND METHOD OF MANUFACTURING THE SAME

RELATED APPLICATION DATA

This application is a National Stage Application under 35 U.S.C. 371 of PCT application number PCT/JP2018/029879 designating the United States and filed Aug. 9, 2018; which claims the benefit of JP application number 2017-212753 and filed Nov. 2, 2017 each of which are hereby incorporated by reference in their entireties.

TECHNICAL FIELD

The present invention relates to a piercer plug and a method of manufacturing such a plug, and particularly to a piercer plug used in piercing/rolling to manufacture a seamless steel pipe and a method of manufacturing such a plug.

BACKGROUND ART

A piercer plug used in piercing/rolling pierces a billet at a high temperature (e.g., 1200° C.), and thus is exposed to an extremely harsh environment. Before use, a piercer plug is provided with an oxide coating or sprayed coating on its surface. Japanese Patent No. 2683861 discloses a hot-forming tool having oxide-based scales on its surface. Japanese Patent Nos. 5464300 and 5440741 each disclose a piercer plug including a build-up layer and a sprayed coating. Japanese Patent No. 2776256 discloses a tool provided with a surface-treatment coating of an Ni-based alloy containing 30 to 55% W.

Each of these coatings wears off due to abrasion and/or peeling as the plug is used for piercing. When the coating has worn off, the piercer plug may be recycled by interrupting its use and providing the plug with a new coating. The base material of the piercer plug (i.e., portions of the piercer plug other than the coating; hereinafter sometimes simply referred to as "base material"), after receiving high surface pressures, may have been deformed. Recycling is possible if the amount of deformation of the base material is small, but not possible if the amount of deformation is significant. On the other hand, if a harder base material is used to reduce the amount of deformation, cracking may occur in the trunk portion.

Japanese Patent Nos. 2778140 and 2819906 each disclose a hot-working tool made of an Ni-based alloy. These hot-working tools have good high-temperature strengths as their base material is made of an Ni-based alloy, but require the correspondingly high costs.

WO 2014/050975 discloses a material for a piercer plug for manufacturing a seamless steel pipe, where a heat treatment adjusts their hardness to be not lower than HRC 6 and not higher than HRC 40.

WO 2017/051632 discloses a piercer plug with a tip portion subjected to high-frequency heating, for example, such that the tip portion is harder than the cylindrical portion.

DISCLOSURE OF THE INVENTION

In recent years, the demand for seamless steel pipes made of a processing-resistant material, such as stainless steel or high-alloy steel, has been growing as environments in which to drill oil wells have become harsher. To increase the recyclability of piercer plugs used to manufacture such seamless steel pipes, their deformation resistance must be further increased.

Another consideration is that, before a piercer plug is recycled, the old coating must be removed by blasting, for example. The tip portion of the piercer plug may be chipped during this process, which makes recycling impossible.

An object of the present invention is to provide a piercer plug with increased recyclability and a method of manufacturing such a plug.

A piercer plug according to an embodiment of the present invention has a chemical composition of, in mass %: 0.15 to 0.30% C; 0.4 to 1.2% Si; 0.2 to 1.5% Mn; 0.1 to 2.0% Ni; 0 to 4.0% Mo and 0 to 4.0% W, where a total content of Mo and W is 1.0 to 6.0%; higher than 1.0% and not higher than 4.0% Cr; 0 to 0.2% B; 0 to 1.0% Nb; 0 to 1.0% V; 0 to 1.0% Ti; and balance Fe and impurities, the plug including a tip portion and a trunk portion made of the same material as the tip portion and contiguous to the tip portion, the trunk portion including a cylindrical portion having a hole used to mount a bar, the tip portion being harder than the cylindrical portion.

A method of manufacturing a piercer plug according to an embodiment of the present invention includes the steps of: preparing a piercer plug having a chemical composition of, in mass %: 0.15 to 0.30% C; 0.4 to 1.2% Si; 0.2 to 1.5% Mn; 0.1 to 2.0% Ni; 0 to 4.0% Mo and 0 to 4.0% W, where a total content of Mo and W is 1.0 to 6.0%; higher than 1.0% and not higher than 4.0% Cr; 0 to 0.2% B; 0 to 1.0% Nb; 0 to 1.0% V; 0 to 1.0% Ti; and balance Fe and impurities, the plug including a tip portion and a trunk portion made of the same material as the tip portion and contiguous to the tip portion; and heating the piercer plug in such a manner that the tip portion is at a temperature not lower than an $A_{C3}$ point and a cylindrical portion of the trunk portion having a hole used to mount a bar is at a temperature below the $A_{C3}$ point.

The present invention provides a piercer plug with increased recyclability.

EMBODIMENTS FOR CARRYING OUT THE INVENTION

Figure 1:
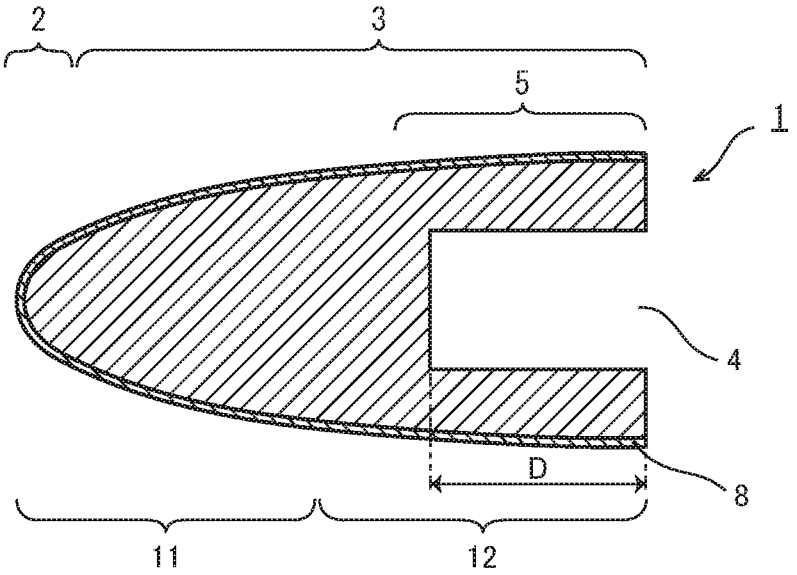
FIG. 1 is a longitudinal cross-sectional view of a piercer plug according to an embodiment of the present invention.

To increase the recyclability of a piercer plug, the hardness of the base material must be increased to reduce the amount of deformation of the base material. On the other hand, if the hardness of the base material is too high, cracking may occur in the trunk portion during piercing. To prevent cracking, it is preferable to increase the toughness of the piercer plug. The problem here is the difficulty of providing both high hardness and high toughness.

The inventors investigated the deformation behavior and cracking behavior of base materials and obtained the following findings, (1) and (2):

(1) base-material deformation is significant in the tip portion of a plug, which, during piercing, experiences high temperatures and higher surface pressures than all the other portions of the plug; and (2) a crack initiates in a portion of the trunk portion that is associated with the hole into which the mandrel (or bar) is to be inserted (hereinafter referred to as "cylindrical portion").

Based on this finding, the inventors found that both reduction in deformation and prevention of cracking may be achieved if the tip portion of the piercer plug is harder than the cylindrical portion. The inventors also found that the tip portion may be made harder than the cylindrical portion by heating the piercer plug in such a manner that the tip portion is at a temperature not lower than the $A_{C3}$ point and the temperature of the cylindrical portion is lower than the $A_{C3}$ point.

To increase the hardness of the tip portion, the plug may contain larger amounts of elements that improve hardenability. Even if the plug contains larger amounts of elements that improve hardenability, the toughness of the cylindrical portion is maintained because the temperature of the cylindrical portion does not rise to or above the $A_{C3}$ point.

Further, the inventors investigated the problem of the tip portion of the piercer plug being chipped during removal of the old coating and thus making recycling impossible. The inventors found that such chipping is caused by the tip portion of the piercer plug being hardened by temperature history during piercing. That is, during piercing, the tip of the piercer plug is heated to or above the $A_{C3}$ point and, after piercing, is rapidly cooled by a plug coolant. At this moment, the tip portion of the piercer plug is excessively hardened, leading to embrittlement.

To prevent hardening due to temperature history during piercing, the cooling rate after piercing may be reduced (by, for example, not performing water cooling). However, if the cooling rate is reduced, the insufficient cooling shortens the life of the piercer plug. Thus, it is necessary to adjust the chemical composition of the piercer plug to appropriately control hardenability.

As discussed above, the piercer plug is often used after being provided with oxide scales on its surface, which means that the main purpose of the heat treatment is to form oxide scales. Consequently, the chemical composition has not been adjusted with a focus on hardenability. Further, steel with high Cr content has rarely been used in piercer plugs, particularly ones intended to pierce stainless steel, because, for example, Cr is an oxidation-resistant ingredient that hampers the formation of oxide scales and also tends to cause seizure in conjunction with a Cr-containing billet. The present inventors succeeded in achieving, all at the same time, reduction in deformation and prevention of cracking and even prevention of chipping during removal of a coating by adjusting the chemical composition of the piercer plug and appropriately controlling hardenability.

The present invention was made based on these finding. Now, embodiments of the present invention will be described in detail with reference to the drawings. The same or corresponding portions in drawings are labeled with the same characters, and their description will not be repeated. The size ratios between the components in the drawings do not necessarily represent the actual size ratios.

[Piercer Plug]

The piercer plug according to the present embodiment (hereinafter simply referred to as "plug") has a chemical composition as specified below. "%" for elements as used below means mass percentage.

C: 0.15 to 0.30%

Carbon (C) is effective in improving high-temperature strength. This effect is not sufficiently produced if the C content is below 0.15%. On the other hand, if the C content exceeds 0.30%, this results in an excessively high hardness, which means that cracking or chipping can easily occur in the plug. In view of this, the C content should be 0.15 to 0.30%. An upper limit for C content is preferably 0.25%.

Si: 0.4 to 1.2%

Silicon (Si) is effective in deoxidization and in increasing strength. These effects are not sufficiently produced if the Si content is below 0.4%. On the other hand, if the Si content exceeds 1.2%, toughness decreases. In view of this, the Si content should be 0.4 to 1.2%. A lower limit for Si content is preferably 0.5%. An upper limit for Si content is preferably 1.1%.

Mn: 0.2 to 1.5%

Manganese (Mn) stabilizes austenite, and prevents production of 6 ferrite to prevent reduction in toughness. These effects are not sufficiently produced if the Mn content is below 0.2%. On the other hand, if the Mn content exceeds 1.5%, this leads to an excessively high hardness, which means that cracking can easily occur during piercing. In view of this, the Mn content should be 0.2 to 1.5%. A lower limit for Mn content is preferably 0.3%. An upper limit for Mn content is preferably 1.2%, and more preferably 1.0%.

Ni: 0.1 to 2.0%

Nickel (Ni) has the effect of improving the toughness of quench-derived structures formed in the outermost layer of the plug. This effect is not sufficiently produced if the Ni content is below 0.1%. On the other hand, if the Ni content is higher than 2.0%, there is saturation in terms of effect, which means a cost increase. In view of this, the Ni content should be 0.1 to 2.0%. A lower limit for Ni content is preferably 0.2%. An upper limit for Ni content is preferably 1.5%, and more preferably 1.0%.

Mo: 0 to 4.0%, W: 0 to 4.0, where the total content of Mo and W is 1.0 to 6.0%

Molybdenum (Mo) and tungsten (W) are effective in improving high-temperature strength. This effect is not sufficiently produced if the total content of Mo and W is below 1.0%. On the other hand, if the total content of Mo and W exceeds 6.0%, ferrite remains even at high temperatures, which decreases strength and toughness. In view of this, the total content of Mo and W should be 1.0 to 6.0%. A lower limit for the total content of Mo and W is preferably 1.5%, and more preferably 2.0%. An upper limit for the total content of Mo and W is preferably 4.0%, and more preferably 3.0%.

Cr: higher than 1.0% and not higher than 4.0%

Chromium (Cr) improves the hardenability of steel. This effect is not sufficiently produced if the Cr content is not higher than 1.0%. On the other hand, if the Cr content exceeds 4.0%, this leads to an excessively high hardenability, which may result in the tip portion of the plug being excessively hardened for some kinds of temperature history during piercing. In view of this, the Cr content should be higher than 1.0% and not higher than 4.0%. A lower limit for the Cr content is preferably 1.2%, and more preferably 2.0%. An upper limit for Cr content is preferably 3.5%, and more preferably 3.0%.

The balance of the chemical composition of the plug according to the present embodiment is Fe and impurities. Impurity as used herein means an element originating from ore or scrap used as raw material for steel or an element that has entered from the environment or the like during the manufacturing process.

The chemical composition of the plug according to the present embodiment may include one or more of the elements described below to replace some of Fe. All of the elements described below are optional elements. That is, the chemical composition of the plug according to the present embodiment may include only one, or none at all, of the elements described below.

B: 0 to 0.2%

Boron (B) is effective in improving the strength of grain boundaries. This effect is produced if a small amount of B is contained. On the other hand, if the B content exceeds 0.2%, a brittle phase precipitates, reducing toughness. In view of this, the B content should be 0 to 0.2%. A lower limit for B content is preferably 0.002%. An upper limit for B content is preferably 0.1%, and more preferably 0.05%.

Nb: 0 to 1.0%

V: 0 to 1.0%

Ti: 0 to 1.0%

Niobium (Nb), vanadium (V), and titanium (Ti) have the effect of making crystal grains finer. This effect is produced if small amounts of these elements are contained. On the other hand, if the content of any of these elements exceeds 1.0%, toughness decreases. In view of this, each of the Nb, V and Ti contents should be 0 to 1.0%. A lower limit for each of the Nb, V and Ti contents is preferably 0.2%.

FIG. 1 is a longitudinal cross-sectional view of a plug 1 according to an embodiment of the present invention. The plug 1 is projectile-shaped. The plug 1 includes a tip portion 2 and a trunk portion 3. The plug 1 has a transverse cross section that is circular in shape, as measured at each of the tip portion 2 and trunk portion 3. The surfaces of the tip portion 2 and trunk portion 3 form a continuous face. The tip portion 2 and trunk portion 3 are formed from the same material and constitute a single part. With respect to the plug 1, the direction toward the tip portion 2 will be hereinafter referred to as toward the front/tip or forward, while the direction toward the trunk portion 3 will be referred to as toward the rear or rearward.

The trunk portion 3 includes a joining hole 4 opening on the rear end surface (i.e., back face) that allows for connection with a bar. The front end of the joining hole 4 (i.e., bottom of the hole) is located, for example, at the center of the entire length of the plug 1 (i.e., distance between the front end of the tip portion 2 and the rear end of the trunk portion 3) or rearward thereof. A rear portion of the plug 1 (i.e., rear portion of the trunk portion 3) is cylindrical in shape due to the presence of the joining hole 4. A portion of the plug 1 extending in the longitudinal direction (or axial direction) and having the joining hole 4 inside will be referred to as cylindrical portion 5. The front end of the cylindrical portion 5 is located 0.1×D [mm] forward of the front end of the joining hole 4, where D [mm] is the distance between the front end of the joining hole 4 and the rear end thereof (i.e., opening end) as measured in the longitudinal direction of the plug 1, i.e., depth of the joining hole 4. That is, as measured in the longitudinal direction of the plug 1, the cylindrical portion 5 is the portion of the plug 1 located between the position 0.1×D [mm] forward of the front end of the joining hole 4 and the rear end of the plug 1. The plug 1 may further include a roll-off portion located rearward of the trunk portion 3.

Figure 2:
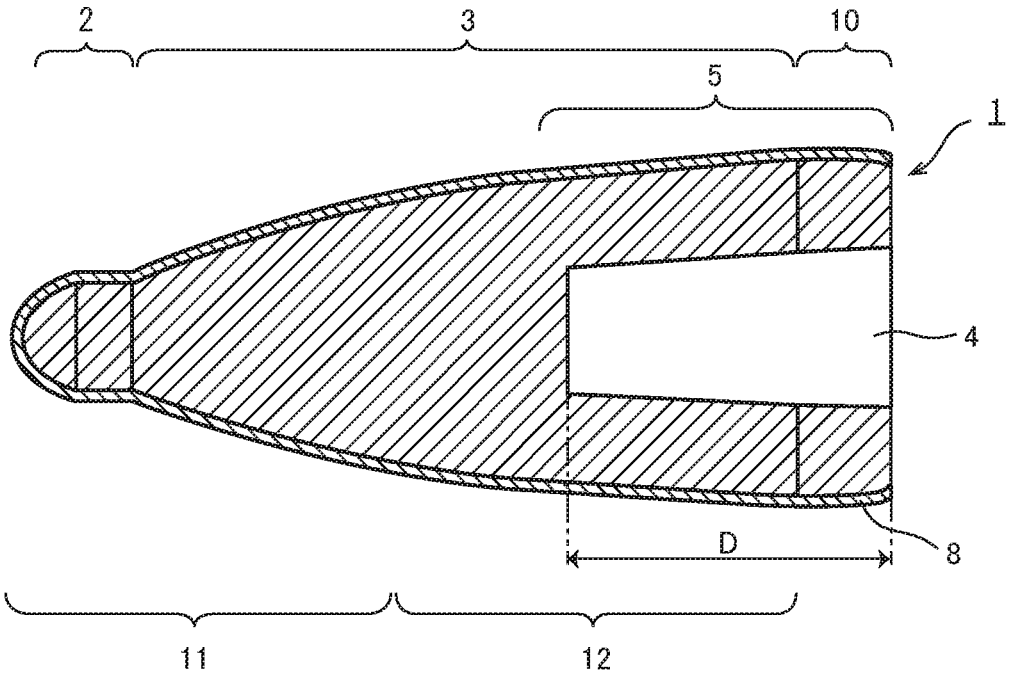
FIG. 2 is a longitudinal cross-sectional view of an alternative piercer plug with a different shape from that of FIG. 1.

As shown in FIG. 2, the plug 1 may be shaped to have a tip portion 2 protruding in a convex manner. The plug 1 shown in FIG. 2 further includes a roll-off portion 10 located rearward of the trunk portion 3.

Figure 3:
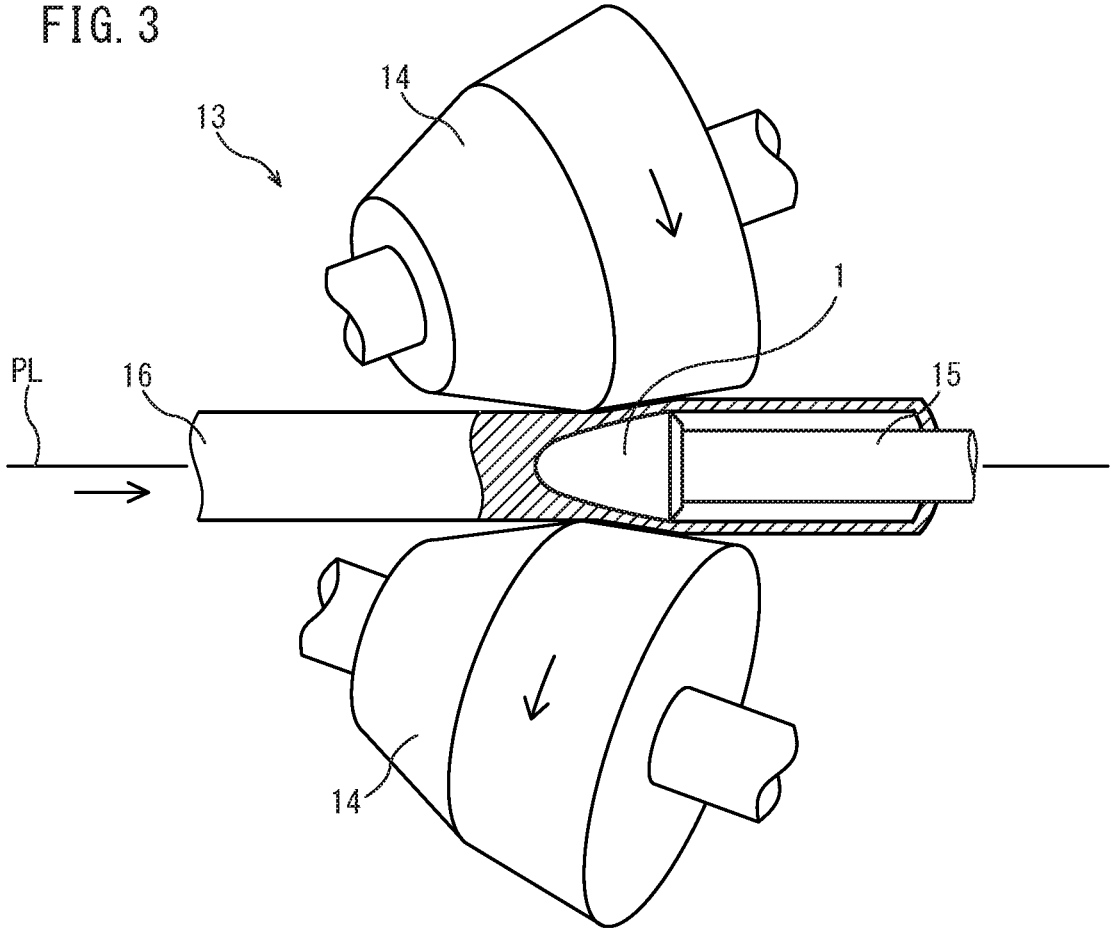
FIG. 3 is a schematic view of a piercing/rolling mill including a piercer plug.

As shown in FIG. 3, the plug 1 is used in the piercing/rolling mill 13 for piercing/rolling, where the tip of a bar (or mandrel) 15 is attached into the joining hole 4. The plug 1 is positioned on a pass line PL between a pair of skewed rolls 14. During piercing/rolling, the plug 1, starting with its tip portion 2, contacts a solid billet 16. The plug 1 is exposed to high temperatures and receives high pressures.

To describe from another viewpoint, as shown in FIG. 1 or 2, the plug 1 is divided into a rolling portion 11 and a reeling portion 12. The rolling portion 11 is represented by the entire tip portion 2 and a front portion of the trunk portion 3 contiguous to the tip portion 2, and the reeling portion 12 is the portion of the trunk portion 3 located rearward of the rolling portion 11. The rolling portion 11 receives a major part of the thickness-reducing rolling during piercing/rolling. The reeling portion 12 finishes the wall thickness of a hollow shell (or simply shell) during piercing/rolling.

The tip portion 2 is harder than the cylindrical portion 5. The Vickers hardness of the tip portion 2 is preferably not lower than 300 Hv, and more preferably not lower than 350 Hv. The Vickers hardness of the cylindrical portion 5 is preferably 220 to 260 Hv. Vickers hardness is a value provided by a measurement on a cross section of the plug 1 along the longitudinal direction in accordance with JIS Z 2244 (2009), with a testing force of 1 kgf.

As measured in a Charpy impact test using a full-size test specimen in accordance with JIS Z 2242 (2005) at 40° C., the cylindrical portion 5 preferably has an amount of absorbed energy not smaller than 25 J/cm$^2$. The amount of absorbed energy of the cylindrical portion 5 is preferably not smaller than 30 J/cm$^2$, and more preferably not smaller than 50 J/cm$^2$.

A tip portion 2 that is harder than the cylindrical portion 5 prevents the deformation of the tip portion 2 due to piercing/rolling. If the cylindrical portion 5 is as hard as the tip portion 2, this means a low toughness of the cylindrical portion 5, in which case piercing/rolling causes cracking in the cylindrical portion 5. The plug 1 of the present embodiment is a plug having a tip portion 2 and a trunk portion 3 formed from the same material, where only the tip portion 2 has a relatively high hardness, and thus provides a tip portion 2 with improved hardness and a cylindrical portion 5 having a desired toughness. As a result, the plug 1 prevents deformation of the tip portion 2 while preventing cracking in the cylindrical portion 5, thus increasing recyclability.

The plug 1 further includes a protective layer 8. The protective layer 8 includes at least one of a sprayed coating and a build-up layer. The plug 1 may include both a sprayed coating and a build-up layer that provide the protective coating 8. In such implementations, a sprayed coating may be formed on some portions of the surface of the plug 1 and a build-up layer may be formed on other portions of the plug surface. Alternatively, a build-up layer and a sprayed coating may formed on the surface of the plug 1 so as to overlie each other.

Although the sprayed coating is not limited to a particular one, it may be a sprayed coating mainly composed of iron and iron oxides, for example. Although the build-up layer is not limited to a particular one, it may be an alloy mainly composed of a transition metal, for example. This alloy may be, for example, an alloy mainly composed of cobalt and containing chromium and tungsten (i.e., Stellite alloy).

The protective layer 8 preferably covers those portions of the plug surface included in the rolling portion 11. More preferably, the protective layer 8 covers the entire surface of the plug except for the rear end surface. It is preferable that the thickness of the protective layer 8 vary depending on the position, and it is preferable that the portion of the protective layer 8 provided on the surface of the tip portion 2 be thicker than the portion of the protective layer 8 provided on the surface of the trunk portion 3.

FIGS. 1 and 2 depict implementations where the plug 1 includes a protective layer 8. Nevertheless, a protective layer 8 is only provided if necessary. The plug of the present embodiment may not include a protective layer 8.

[Manufacture Method]

Figure 4:
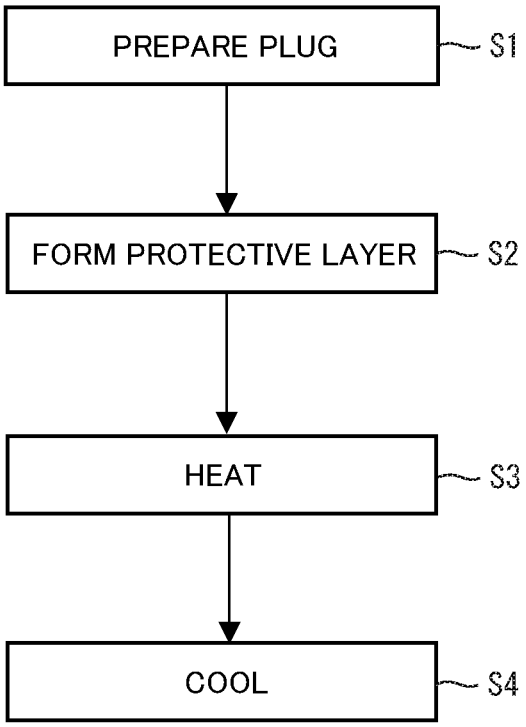
FIG. 4 is a flow chart of a manufacturing method according to an embodiment of the present invention.

FIG. 4 is a flow chart of a method of manufacturing the plug according to an embodiment of the present invention. The manufacture method includes a step where a plug is prepared, S1; a step where a protective layer is formed on the plug, S2; a step where the plug is heated, S3; and a step where the plug is cooled, S4.

[Step S1]

A plug is prepared. A plug may be produced, for example, in the following manner: A steel having a chemical composition as specified above is melted and cast into a shape close to a plug shape, providing a roughly shaped product. An annealing process is performed in which the roughly shaped product is held at 650 to 850° C. for 2 to 6 hours and is then cooled in the furnace. Thereafter, the roughly shaped product is machined to provide the final plug shape.

[Step S2]

A protective layer 8 is formed on the plug as necessary. If the protective layer 8 is a sprayed coating, it may be formed by arc spraying, plasma spraying, flame spraying, or high-speed flame spraying, for example. If the protective layer 8 is a build-up layer, it may be formed by plasma powder build-up welding, MIG welding, or TIG welding, for example.

Step S2 is optional. That is, step S2 may not be performed. Further, although FIG. 3 illustrates an implementation in which step S2 precedes step S3, step S2 is not limited to this timing. Although it is preferable that step S2 precede step S3, step S2 may be performed after steps S3 or S4.

[Step S3]

The tip portion 2 of the plug is heated. The heating is such that the temperature of the tip portion 2 rises to the austenite transformation temperature (i.e., $A_{C3}$ point) or higher and the temperature of the cylindrical portion 5 remains below the $A_{C3}$ point. The cylindrical portion 5, which should remain at temperatures below the $A_{C3}$ point, is, as discussed above, the portion located between the position 0.1×D [mm] forward of the front end of the joining hole 4 and the rear end of the plug. In other words, the region defined by the rear end of the plug and the position 0.1×D [mm] forward of the front end of the joining hole 4 is heated so as to remain below the $A_{C3}$ point.

Figure 5:
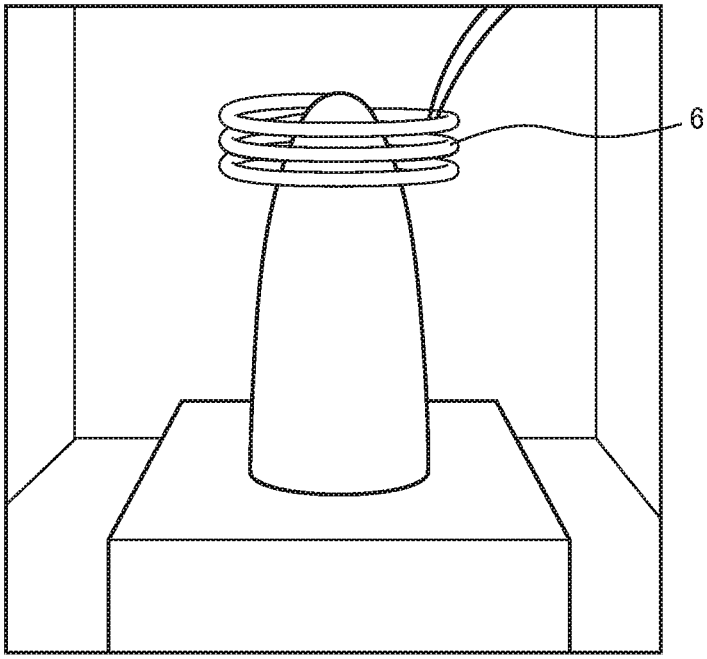
FIG. 5 is a schematic view of a heating apparatus.

For this heating treatment, for example, as shown in FIG. 5, a high-frequency coil 6 may be attached to the outer periphery of the tip portion 2, and the plug may be placed in a heating apparatus before the coil 6 is used to perform high-frequency heating on the tip portion 2 at a temperature of 950 to 1200° C. More preferably, the heating temperature is 950 to 1100° C. The heating is only required to be done for a period of time sufficient to cause the portion to be hardened; if high-frequency heating is used, the heating only needs to be done for several seconds at a temperature that is not lower than the $A_{C3}$ point; however, to achieve industrial stability, the heating time is preferably 20 seconds or longer, and more preferably one minute or longer. The heating time is preferably not longer than 20 minutes, and more preferably not longer than 10 minutes. Particularly, if the heating treatment is performed in an environment other than an inert gas atmosphere (for example, in the ambient air), the heating time is preferably not longer than 10 minutes, and more preferably not longer than 5 minutes, because heating for a prolonged period of time may cause a change to the nature of the protective layer 8. For example, in the ambient air, the protective layer 8 may be oxidized to an unacceptable degree. The heating treatment discussed above makes it possible to raise the temperature of the tip portion 2 to a level that is not lower than the $A_{C3}$ point and maintain the temperature of the cylindrical portion 5 below the $A_{C3}$ point. The device for heating the plug is not limited to a high-frequency coil 6.

Figure 6:
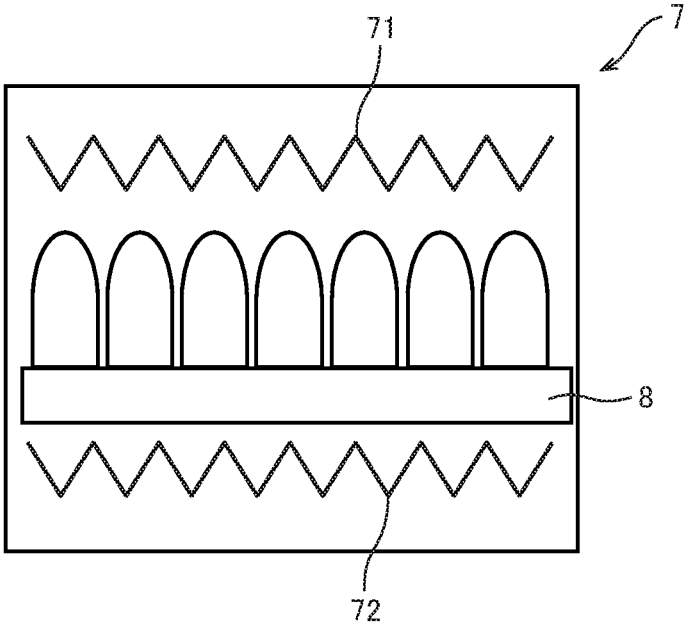
FIG. 6 is a schematic view of a heating apparatus different from the heating apparatus shown in FIG. 5.

FIG. 6 shows an example of an apparatus for heating the plug without the use of a high-frequency coil 6. The heating apparatus 7 shown in FIG. 6 includes heaters 71 and 72. The heater 71 is located adjacent to the top of the heating apparatus 7. The heater 72 is located adjacent to the bottom of the heating apparatus 7.

Before step S3 is performed, the plug is loaded into the heating apparatus 7. Preferably, a plurality of plugs are loaded into the heating apparatus 7. A shield 8 is placed between the plugs and heater 72. That is, the shield 8 is positioned above the heater 72 and the plugs are mounted on the shield 8. The shield 8 reduces transmission of heat from the heater 72 to the plugs. The shield 8 may be shaped as a grid or a plate, for example. The shield 8 may be coated with an oxide.

The plugs in the heating apparatus 7 are heated by the heaters 71 and 72. The heaters 71 and 72 may operate at the same heating temperature (preset temperature). Preferably, the heating apparatus 7 contains an inert gas atmosphere, such as Ar. When the temperature of the tip portions 2 of the plugs has reached a predetermined temperature that is not lower than the $A_{C3}$ point, the plugs are removed from the heating apparatus 7. Since the shield 8 works such that the amount of heat transmitted to the lower portion of each plug is smaller than the amount of heat transmitted to the upper portion of the plug, the temperature of the cylindrical portion 5 is lower than the temperature of the tip portion 2. At the time point when the plug is removed from the heating apparatus 7, the temperature of the cylindrical portion 5 has not reached the $A_{C3}$ point and is below the $A_{C3}$ point.

The plugs may be heated by the heating apparatus 7 without a shield 8. If this is the case, the heating temperature of the heater 72 located below the plugs is adjusted to be lower than the heating temperature of the heater 71 located above the plugs. This ensures that the amount of heat transmitted to the upper portion of each plug is relatively large and the amount of heat transmitted to the lower portion of the plug is relatively small. Thus, as is the case with implementations using the shield 8, the plug may be heated such that the temperature of the tip portion 2 rises to the $A_{C3}$ point or higher and the temperature of the cylindrical portion 5 remains below the $A_{C3}$ point.

A thermocouple may be attached to each of the tip portion 2 and cylindrical portion 5 of each plug in the heating apparatus 7, for example, to measure the temperature of the associated tip portion 2 or cylindrical portion 5. This makes it possible to detect that the temperature of the tip portion 2 has reached a predetermined temperature that is not lower than the $A_{C3}$ point while the temperature of the cylindrical portion 5 is below the $A_{C3}$ point, and remove the plug from the heating apparatus 7 at a suitable moment. The temperatures of the tip portion 2 and cylindrical portion 5 need not be measured each time step S3 is performed. An appropriate heating time can be learned by performing temperature measurement once, and this heating time can be used for plugs of the same type to perform step S3.

[Step S4]

The plug which has been heated at step S3 is cooled. For example, power supply to the coil 6 is stopped and the door of the heating apparatus is opened to cool the plug to a temperature not higher than 400° C., typically to room temperature. This results in a plug 1. The cooling rate is only required to be sufficient to cause the plug to be hardened, and the plug may generally be left to cool or may be cooled at a higher rate.

As has been demonstrated by the above, in the plug 1 produced by this manufacture method, the tip portion 2 is heated to a temperature not lower than the $A_{C3}$ point to improve the hardness of the tip portion 2. Further, in the plug 1, the decrease in the toughness of the cylindrical portion 5 due to the heating can be reduced by keeping the temperature of the cylindrical portion 5 below the $A_{C3}$ point. As a result, the plug 1 includes a tip portion 2 with improved hardness and a cylindrical portion 5 having a desired toughness.

The manufacture of the plug 1 is not limited to the above-described method. For example, only the cylindrical portion 5 may be tempered to produce a plug 1 with a tip portion 2 having a higher hardness than the cylindrical portion 5. For example, a plug may be prepared where the entire plug (i.e., tip portion 2 and trunk portion 3) has a Vickers hardness of 300 Hv or higher, and only the cylindrical portion 5 may be tempered to produce a plug 1 with a tip portion 2 having a Vickers hardness of 300 Hv or higher and a cylindrical portion 5 having a Vickers hardness of 220 to 260 Hv.

EXAMPLES

Now, the present invention will be described in more detail with reference to examples. The examples are not intended to limit the present invention.

Steels with the chemical compositions listed in Table 1, A to N, were melted and cast into a shape close to a plug shape. "–" in Table 1 indicates that the content of the relevant element was at an impurity level. The $A_{C3}$ point of these steels was approximately 920° C.

[Table 1]

TABLE 1

| Composition | Chemical composition (in mass %, balance Fe and impurities) | | | | | | | | | | |
|---|---|---|---|---|---|---|---|---|---|---|---|
| | C | Si | Mn | Ni | Cr | Mo | W | V | Nb | Ti | B |
| A | 0.15 | 0.5 | 0.5 | 1.0 | 0.5 | 1.4 | 3.5 | — | — | — | — |
| B | 0.15 | 1.0 | 0.4 | 0.2 | 1.0 | 0.7 | 1.5 | — | — | — | — |

TABLE 1-continued

| Composition | Chemical composition (in mass %, balance Fe and impurities) | | | | | | | | | | |
|---|---|---|---|---|---|---|---|---|---|---|---|
| | C | Si | Mn | Ni | Cr | Mo | W | V | Nb | Ti | B |
| C | 0.15 | 1.0 | 0.4 | 0.2 | 2.0 | 0.7 | 1.5 | — | — | — | — |
| D | 0.15 | 1.0 | 0.4 | 0.2 | 3.0 | 0.7 | 1.5 | — | — | — | — |
| E | 0.20 | 1.0 | 0.4 | 0.2 | 3.0 | 0.7 | 1.5 | — | — | — | — |
| F | 0.25 | 1.0 | 0.4 | 0.2 | 3.0 | 0.7 | 1.5 | — | — | — | — |
| G | 0.30 | 1.0 | 0.4 | 0.2 | 3.0 | 0.7 | 1.5 | — | — | — | — |
| H | 0.35 | 1.0 | 0.4 | 0.2 | 3.0 | 0.7 | 1.5 | — | — | — | — |
| I | 0.30 | 1.0 | 0.4 | 0.2 | 4.0 | 0.7 | 1.5 | — | — | — | — |
| J | 0.30 | 1.0 | 0.4 | 0.2 | 5.0 | 0.7 | 1.5 | — | — | — | — |
| K | 0.15 | 1.0 | 0.4 | 0.2 | 2.0 | 0.7 | 1.5 | 0.8 | — | — | — |
| L | 0.15 | 1.0 | 0.4 | 0.2 | 2.0 | 0.7 | 1.5 | — | 0.8 | — | — |
| M | 0.15 | 1.0 | 0.4 | 0.2 | 2.0 | 0.7 | 1.5 | — | — | 0.8 | — |
| N | 0.15 | 1.0 | 0.4 | 0.2 | 3.0 | 0.7 | 1.5 | — | — | — | 0.005 |

The roughly shaped plug product that had been cast was subjected to an annealing process in which the plug was held at 800° C. for 4 hours in the ambient air and was then cooled in the furnace. Thereafter, the outer surface was machined to provide a predetermined test-plug shape. For each composition, a plug provided with an Fe sprayed coating and a plug without such a coating were fabricated.

Each of the plugs with and without a sprayed coating was heated in an Ar atmosphere such that the tip portion was in the range of 900 to 1100° C. and the temperature of the cylindrical portion was below 800° C. The heating was performed by a heating apparatus including a high-frequency coil as described with reference to FIG. 4, and the heating time was 10 minutes. After the heating, the door of the heating apparatus was opened and the plug was left to cool to near room temperature.

A Charpy test specimen was prepared by taking a sample from the cylindrical portion of each plug without a sprayed coating and machining it, and Charpy impact testing was conducted to measure the amount of absorbed energy. The Charpy impact testing used a full-size test specimen in accordance with JIS Z 2242 (2005), which was measured at 40° C.

Similarly, a test specimen for hardness measurement was prepared by taking a sample from the tip portion of a plug without a sprayed coating and machining it, and its Vickers hardness was measured at normal temperature. The measurement of Vickers hardness was done in accordance with JIS Z 2244 (2009). The testing force was 1 kgf.

Each plug with a sprayed coating was used to conduct 3 passes of piercing/rolling testing, where piercing/rolling was performed on a billet made of SUS 304, and the plug after piercing/rolling was observed to determine the presence/absence of a crack and the amount of base-material deformation (i.e., length of contraction in the L direction) was measured. Further, after the piercing/rolling, the sprayed coating was removed by shot blasting, and the plug after the removal of the sprayed coating was observed to determine the presence/absence of a chip.

The test results are shown in Table 2.

[Table 2]

TABLE 2

| Test No. | Composition | Heat treat. temp. for tip (° C.) | Cylinder Charpy (J/cm$^2$) | Normal-temp. hardness for tip (HV) | Base-material deformation (μm) | Chipping | Cracking | Other |
|---|---|---|---|---|---|---|---|---|
| 1 | A | 1000 | 90 | 305 | 250 | no | no | comp. ex. |
| 2 | B | 1000 | 90 | 345 | 210 | no | no | comp. ex. |
| 3 | C | 1000 | 100 | 370 | 190 | no | no | inv. ex. |
| 4 | D | 900 | 110 | 250 | 270 | no | no | comp. ex. |

TABLE 2-continued

| Test No. | Composition | Heat treat. temp. for tip (° C.) | Cylinder Charpy (J/cm$^2$) | Normal-temp. hardness for tip (HV) | Base-material deformation (μm) | Chipping | Cracking | Other |
|---|---|---|---|---|---|---|---|---|
| 5 | D | 950 | 110 | 380 | 185 | no | no | inv. ex. |
| 6 | D | 1000 | 110 | 400 | 170 | no | no | inv. ex. |
| 7 | D | 1050 | 110 | 400 | 170 | no | no | inv. ex. |
| 8 | D | 1100 | 110 | 395 | 175 | no | no | inv. ex. |
| 9 | E | 1000 | 65 | 415 | 165 | no | no | inv. ex. |
| 10 | F | 1000 | 40 | 420 | 150 | no | no | inv. ex. |
| 11 | G | 1000 | 30 | 420 | 150 | no | no | inv. ex. |
| 12 | H | 1000 | 25 | 415 | 155 | no | present | comp. ex. |
| 13 | I | 1000 | 25 | 420 | 155 | no | no | inv. ex. |
| 14 | J | 1000 | 14 | 420 | 155 | present | present | comp. ex. |
| 15 | J | 950 | 20 | 400 | 155 | present | no | comp. ex. |
| 16 | K | 1000 | 105 | 380 | 185 | no | no | inv. ex. |
| 17 | L | 1000 | 110 | 390 | 180 | no | no | inv. ex. |
| 18 | M | 1000 | 105 | 385 | 190 | no | no | inv. ex. |
| 19 | N | 1000 | 115 | 410 | 160 | no | no | inv. ex. |

The plug labeled Test No. 1 was the same that was described in WO 2017/051632. The amounts of base-material deformation were evaluated with reference to the amount of base-material deformation of Test No. 1.

The plug labeled Test No. 2 was the same as the reference except that the Cr content was 1.0% (Composition B). This plug exhibited a reduced amount of base-material deformation compared with the plug of Test No. 1; still, the effect was small.

The plug labeled Test No. 3 had a Cr content of 2.0% (Composition C). It provided a toughness (or Charpy absorbed energy) substantially equal to that of the plug of Test No. 1 and, in addition, had a hardness at normal temperature improved by 20% or more and, as a result, an amount of base-material deformation reduced by about 20%. Further, no cracking nor chipping occurred.

For the plug labeled Test No. 4, the hardness of the tip portion at normal temperature was low. This is presumably because the temperature of the tip portion during the heat treatment was low.

The plugs labeled Test Nos. 5 to 8 had a Cr content of 3.0% (Composition D). Each of these plugs provided a toughness substantially equal to that of the plug of Test No. 1 and, in addition, had a hardness at normal temperature improved by about 30% and, as a result, a significantly reduced amount of base-material deformation. Further, no cracking nor chipping occurred. Furthermore, these plugs had Mo and W contents that were half those of the plug of Test No. 1, and are expected to lead to cost reductions.

The plugs labeled Test Nos. 9 to 12 had incremental C contents relative to Composition D (Compositions E to H). The hardness at normal temperature was found to tend to increase as the C content increased, and the amount of base-material deformation decreased correspondingly. On the other hand, the toughness tended to decrease as the C content increased; cracking occurred in the plug of Test No. 12.

The plug labeled Test No. 13 had a C content of 0.30% and a Cr content of 4.0% (Composition I). The plug of Test No. 13 had a hardness at normal temperature substantially equal to that of the plug of Test No. 11 (Composition G). It had a lower toughness than the plug of Test No. 11, but developed no cracks.

The plug labeled Test No. 14 had a C content of 0.30% and a Cr content of 5.0% (Composition J). Cracking and chipping occurred in the plug of Test No. 14.

The plug labeled Test No. 15 was the same as the plug of Test No. 14 except that the heat-treatment temperature was 950° C. The plug of Test No. 15 developed no cracks, but suffered chipping.

The plugs labeled Test Nos. 16 to 18 were the same as the plug of Test No. 3 (Composition C) except that they additionally contained V, Nb and Ti, respectively (Compositions K, L and M). Due to the effect of V, Nb or Ti of making grains finer, these plugs had improved normal-temperature hardness and toughness compared with the plug of Test No. 3.

The plug labeled Test No. 19 was the same as the plug of Test No. 6 (Composition D) except that it additionally contained B (Composition N). Due to the effect of B of improving grain-boundary strength, this plug had improved normal-temperature hardness and toughness compared with the plug of Test No. 6.

Although embodiments of the present invention have been described, the above-illustrated embodiments are merely examples for carrying out the present invention. Accordingly, the present invention is not limited to the above-illustrated embodiments, and the above-illustrated embodiments, when carried out, may be modified as appropriate without departing from the spirit of the invention.

The invention claimed is:

1. A piercer plug having a chemical composition of, in mass %:

0.15 to 0.30% C;
0.4 to 1.2% Si;
0.2 to 1.5% Mn;
0.1 to 2.0% Ni;
0 to 4.0% Mo and 0 to 4.0% W, where a total content of Mo and W is 1.0 to 6.0%;
higher than 1.0% and not higher than 4.0% Cr;
0 to 0.2% B;
0 to 1.0% Nb;
0 to 1.0% V;
0 to 1.0% Ti; and
balance Fe and impurities,
the piercer plug comprising:
a tip portion; and
a trunk portion made of the same material as the tip portion and contiguous to the tip portion,
the trunk portion including a cylindrical portion having a hole used to mount a bar,
the tip portion being harder than the cylindrical portion, wherein a Vickers hardness of the tip portion is 370 to 420 Hv, a Vickers hardness of the cylindrical portion is 220 to 260 Hv, and an amount of absorbed energy of the cylindrical portion, as measured in a Charpy impact test using a full-size test specimen in accordance with JIS Z 2242 (2005) at 40° C., is 30 to 115 J/cm$^2$.

2. The piercer plug according to claim 1, further comprising:

a protective layer formed on a surface of the piercer plug, wherein the protective layer includes at least one of a sprayed coating and a build-up layer.

3. A method of manufacturing the piercer plug of claim 1, comprising the steps of:

preparing the piercer plug having a chemical composition of, in mass %: 0.15 to 0.30% C; 0.4 to 1.2% Si; 0.2 to 1.5% Mn; 0.1 to 2.0% Ni; 0 to 4.0% Mo and 0 to 4.0% W, where a total content of Mo and W is 1.0 to 6.0%; higher than 1.0% and not higher than 4.0% Cr; 0 to 0.2% B; 0 to 1.0% Nb; 0 to 1.0% V; 0 to 1.0% Ti; and balance Fe and impurities, the piercer plug including the tip portion and the trunk portion made of the same material as the tip portion and contiguous to the tip portion; and heating the piercer plug in such a manner that the tip portion is at a temperature not lower than an $A_{C3}$ point and a cylindrical portion of the trunk portion having a hole used to mount a bar is at a temperature below the $A_{C3}$ point.

4. The method of manufacturing the piercer plug according to claim 3, further comprising:

before the step of heating, the step of forming a protective layer on a surface of the piercer plug, wherein the protective layer includes at least one of a sprayed coating and a build-up layer.

* * * * *